United States Patent [19]

Jariwala

[11] 4,000,435

[45] Dec. 28, 1976

[54] ELECTRON GUN CATHODE WITH A FAST WARM-UP CHARACTERISTIC

[75] Inventor: Praveen K. Jariwala, Hammondsport, N.Y.

[73] Assignee: Westinghouse Electric Corporation, Pittsburgh, Pa.

[22] Filed: June 20, 1975

[21] Appl. No.: 588,926

[52] U.S. Cl. ..... 313/446; 313/337; 313/345

[51] Int. Cl.[2] ..... H01J 29/04; H01J 1/24

[58] Field of Search ..... 313/446, 345

[56] References Cited

UNITED STATES PATENTS

| | | | |
|---|---|---|---|
| 2,386,790 | 10/1945 | Gaun et al. | 313/466 X |
| 3,549,929 | 12/1970 | Pappadis | 313/446 X |
| 3,881,124 | 4/1975 | Buescher et al. | 313/446 X |
| 3,883,767 | 5/1975 | Buescher et al. | 313/341 |

*Primary Examiner*—Robert Segal
*Attorney, Agent, or Firm*—W. G. Sutcliff

[57] ABSTRACT

An electron gun cathode for a cathode ray tube in which the cathode has a fast warm-up characteristic to produce a visible raster within about 6 seconds. The emissively-coated cathode cap is of reduced mass, with the cathode heater coil disposed within the cathode cap having a high weight to length ratio, and with a darkened coating thereon to increase the emissivity therefrom.

1 Claim, 1 Drawing Figure

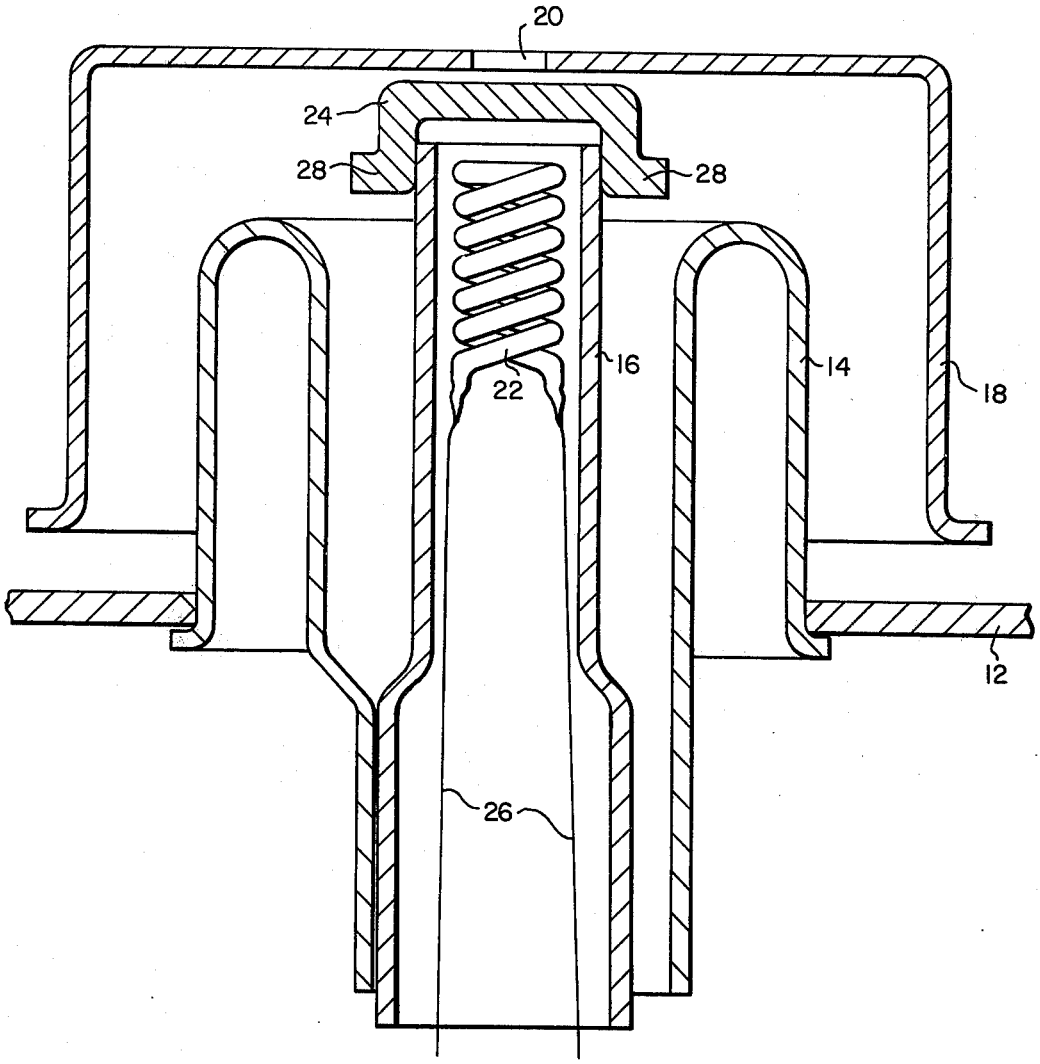
20
24
28
28
16
22
14
18
12
26

ELECTRON GUN CATHODE WITH A FAST WARM-UP CHARACTERISTIC

BACKGROUND OF THE INVENTION

The present invention relates to a cathode element of an electron gun of a cathode ray tube, and more particularly of a color television picture tube. The electron beam raster of a color television picture tube is formed by indirectly heating an emissively-coated cathode member to produce electron emission which is accelerated toward a high voltage anode. A finite time is required to heat the electron emissively-coated member to a stable operating temperature, at which time the electron emission forms a stable raster beam. This finite heating time is responsible for a delay from the turn on of the set to the production of a display image upon the picture tube. This warm-up time has characteristically been of the order of about 20 to 30 seconds.

The on-set time of the display image has been minimized in the past by continuously heating the cathode heater to keep the electron gun cathode at or near operating temperature even while the set is turned off. This feature has the disadvantage of being inefficient energy wise, and presents somewhat of a safety hazard.

It is desirable to be able to turn on the set and have the cathode warm up to operating temperature and produce a visible image in as short a period of time as possible. One approach to providing such a fast warm-up cathode characteristic has been to insulate the emissive portion of the cathode from the bulk of the cathode structure and electron gun structure to minimize the heat dissipation from the heated portion of the cathode. This involves fabrication of a relatively complicated cathode which is expensive to manufacture and requires an insulator stand-off means between the emissive cathode portion and the support structure. Still other fast warm-up cathodes have been proposed in U.S. Pat. No. 3,333,138, which eliminates the need for insulating stand-off means. A plurality of thin conductive support straps connect the cathode cap to the cathode support sleeve. This structure is difficult to manufacture because of the need to properly align and connect these thin support straps, which must accurately maintain the cathode cap in predetermined position relative to the control electrodes of the electron gun.

SUMMARY OF THE INVENTION

An electron gun cathode is provided having a fast warm-up characteristic which produces a visible raster in about 6 seconds. The electron gun cathode structure is very similar to prior art all-metal conventional cathodes. The emissively-coated cathode cap is securely held on the end of the metallic cathode sleeve with the cathode heater element disposed within the cathode sleeve. The fast warm-up characteristic is had by providing that the emissively-coated cathode cap is of reduced mass, and the insulator-coated cathode heater coil disposed within the cathode sleeve proximate the cathode cap has a high weight to length ratio. The coating on the cathode heater is darkened to increase the emissivity therefrom, to rapidly heat the cathode to a stable operating temperature.

BRIEF DESCRIPTION OF THE DRAWINGS

The sole FIGURE is an elevational view partly in section of the electron gun cathode of the present invention.

DESCRIPTION OF THE PREFERRED EMBODIMENT

In the sole FIGURE, only a portion of the electron gun is illustrated, and more particularly the cathode portion and the Gl control electrode are shown. The cathode support member 12 is a conductive member which supports the conductive cathode eyelet 14, in which the generally tubular cathode sleeve 16 is fitted and retained thereby. The cathode support member 12 is in fixed position to support the eyelet 14 and cathode sleeve 16 in a predetermined relationship to the Gl control electrode 18, which is a generally C-shaped member having an aperture means passage 20 therethrough, aligned with the central axis of the cathode sleeve 16. All the elements cited above are conventional. The elements which are changed to provide the fast warm-up characteristics are the coiled-coil heater element 22, which is disposed within the cathode sleeve proximate the cathode cap end. The cathode cap itself is mounted at one end of the cathode sleeve, and is a generally C-shaped member which is force fitted on the cathode sleeve, and may be spot welded thereto.

The cathode heater coil is a coiled-coil, typically of tungsten-rhenium wire, with a nominal diameter of 70 mils, and a body length for the coil of about 2.3 millimeters. The uncoated extending leads 26 for the coil are connected to lead-in pins which supply the power for the heater elements. The coiled-coil is formed of 1.93 mil diameter wire, and the formed coil has a conductor weight of about 4.2 milligrams. The coated coil weight is approximately 10.5 milligrams. An aluminum oxide insulator coating is preferably provided on the wire. This insulator coating of substantially aluminum oxide is darkened by deposition of a thin tungsten layer thereon to change the body color to the desired gray color for high emissivity. The coated heater coil weight is thus about 10.5 milligrams, and has a coiled length of about 2.3 millimeters to provide a very high ratio of weight to length and is typically about 4.56 milligrams per millimeter in length. This weight to length ratio for the fast-on coated heater coil is about twice the weight to length ratio for a standard heater coil. The body color of the coil coating is a darkened grayish body color which has a gray scale rating of 53 as measured on a True Color Type 42D-1000 device available from the Neotec Instrument Co. The cathode heater coil is designed to be operated at a potential of 6.3 volts and a current of 230 milliamps, so that the power input for the heater coil is 1.45 watts. For a 10.5 milligram total insulator-coated coil this is a power input of 0.138 watt per milligram.

The cathode cap 24 differs from the conventional cathode cap in that the thickness of the material is reduced from about 4 mils to about 2.75 mils. More importantly, the length of the legs 28 of the C-shaped cathode cap have been reduced from about 110 mils to about 35 mils. The cathode sleeve structure 16 is the same as in the conventionally used cathode and typically has a length of about 320 mils. Thus, the ratio of cathode sleeve length to cathode cap length is about 9.15, while in a standard design this ratio is only about 2.9. The cathode sleeve, as has already been mentioned, is a conventional sleeve which typically is about 2 mils in thickness. The reduced wall thickness cathode cap is preferably 2.75 mils, and the ratio of cathode sleeve wall thickness to cap wall thickness is about 0.7 in the preferred embodiment. The cathode cap 24 is designed to fit on the end of the cathode sleeve and to be accurately spaced from the Gl control electrode. It has been discovered that the all metal electron gun cathode of the present invention rapidly comes to a stable operating temperature and produces a visible raster within about 6 seconds of initiation of the heater current.

What is claimed is:

1. An electron gun cathode with a fast warm-up characteristic producing a visible raster within about 6 seconds, comprising a generally tubular conductive cathode sleeve which is supported at one end by a conductive cathode eyelet which is in turn supported by a conductive cathode support member, with the free end of the cathode sleeve having a cup-shaped cathode cap fitted on the end with an electron emissive coating provided on the exterior end surface of the cathode cap, which end surface is spaced a predetermined distance from a cup-shaped control grid electrode which has an electron beam aperture therethrough aligned with the central longitudinal axis of the cathode sleeve, and with an insulator-coated cathode heater coil disposed within the cathode sleeve proximate the cathode cap end, the improvement wherein the emissively-coated cathode cap is of reduced mass and the insulator-coated cathode heater coil has a high weight to length ratio of about 4.56 mg per millimeter with a darkened surface coating to increase the emissivity therefrom to rapidly heat the cathode cap to a stable operating temperature, and wherein the ratio of cathode sleeve length to cathode cap length is about 9, and the ratio of cathode sleeve thickness to cathode cap thickness is about 0.7.

* * * * *